United States Patent [19]

Hunter et al.

[11] 4,055,979

[45] Nov. 1, 1977

[54] FORMING OF MATERIALS BY EXTRUSION

[75] Inventors: Eric Hunter, Leyland, England; Derek Green, deceased, late of Langrigg, England, by Muriel Irene Green, executrix

[73] Assignee: United Kingdom Atomic Energy Authority, London, England

[21] Appl. No.: 693,174

[22] Filed: June 7, 1976

[30] Foreign Application Priority Data

July 11, 1975 United Kingdom ..... 29316/75

[51] Int. Cl.[2] ..... B21C 23/08

[52] U.S. Cl. ..... 72/262; 29/125

[58] Field of Search ..... 72/262, 270, 271, 272; 29/125, 130

[56] References Cited

U.S. PATENT DOCUMENTS

| | | | |
|---|---|---|---|
| 2,342,159 | 2/1944 | Moran | 29/125 |
| 3,765,216 | 10/1973 | Green | 72/271 |
| 3,793,869 | 2/1974 | Hufnagl et al. | 29/125 |

*Primary Examiner*—Lowell A. Larson

*Attorney, Agent, or Firm*—Larson, Taylor and Hinds

[57] ABSTRACT

Apparatus for performing extrusion has a rotatable wheel member with an endless groove in its periphery, a second member fixed relative to the wheel member and co-operating therewith to define a passageway therebetween, an abutment member fixed relative to the wheel member and projecting into said groove to block it, die orifice means associated positionally with said abutment member and leading from said passageway, and means for prestressing the material constituting at least the walls of the endless groove for avoiding any fatigue failure problems of the wheel member.

4 Claims, 3 Drawing Figures

FORMING OF MATERIALS BY EXTRUSION

BACKGROUND OF THE INVENTION

This invention relates to the forming of materials by extrusion.

In a known process (see for example commonly assigned U.S. Pat. No. 3,765,216) for extrusion of a material (which may be a metal feedstock) through a die means, the extrusion force is derived by maintaining frictional engagement of the material with passageway-defining surfaces of a member which is moved towards the die means, whereby frictional drag of the passageway-defining surfaces urges the material through the die means.

Apparatus for performing this process conveniently has first and second members defining an elongate passageway therebetween and being movable one relative to the other in the direction of the passageway, has a fixed abutment member to project into and block the passageway, has at least one die orifice leading from the passageway and associated with the abutment member, and also has means for feeding material into the passageway at a position spaced from the abutment member, the amount of surface area of the passageway defined by one of said first and second members which is movable towards the abutment member being greater than the amount of surface area of the passageway defined by the other of said first and second members, whereby material fed into the passageway is moved by frictional drag towards the abutment member and extruded through the or each die orifice. Such apparatus is referred to hereafter as of the kind described. Conveniently but not essentially the member defining the part of the passageway with the greater surface area is a wheel having an endless groove therein, and the other member covers a part of the length of the groove to complete the passageway.

It has been discovered in practice that the straining that the passageway suffers when its walls are subjected to cyclic stressing as the feedstock is compressed in the passageway where the latter is partly defined by an endless groove in the periphery of a wheel, can result in failure by fatigue of the wheel material constituting the walls of the passageway. The mechanism is thought to be that the pressure/temperature cycle experienced by the wheel as it is rotated results in the production of micro fatigue cracks in all the groove surfaces. The feedstock material extrudes into such cracks and propagates them until failure occurs.

SUMMARY OF THE INVENTION

The present invention provides apparatus of the hereinbefore described kind in which one of said first and second members consists of a wheel with an endless groove in its periphery, wherein the material constituting at least the walls of the endless groove is prestressed.

Such prestressing may be effected by superimposing a circumferential compression in the wheel. Such compression is preferably at a higher stress level than the extrusion pressure generated in the groove during operation.

The circumferential compression may be effected by the application of a preloading to the wheel via taper surfaces. Alternatively, the circumferential compression may be effected by employing shrink-fit rings circumferentially positioned on the said wheel.

DESCRIPTION OF THE DRAWING(S)

In order that the invention may be fully understood and more readily performed, constructional embodiments thereof will now be described by way of example with reference to the accompanying drawings, wherein:

FIG. 1 is a diagrammatic, part-sectional elevation of the kind of extrusion apparatus to which the invention relates, FIG. 2 is a fragmentary view in medial section of a portion of an extrusion apparatus according to the invention, and FIG. 3 is a fragmentary sectional view illustrating another embodiment.

DESCRIPTION OF THE PREFERRED EMBODIMENT

Figure 1:
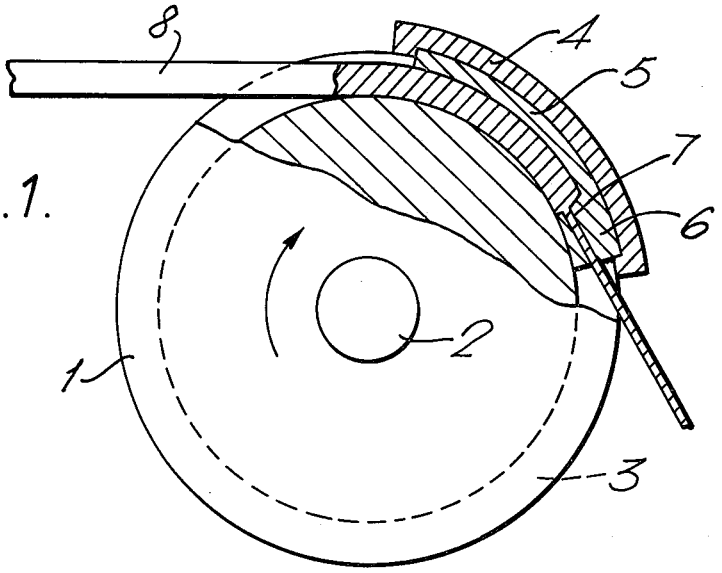

Referring to the drawings, in which like numerals indicate like parts, firstly to FIG. 1 thereof which illustrates diagrammatically known apparatus for performing the kind of extrusion process to which the present invention is applied, the extrusion apparatus shown therein comprises a wheel 1 rotatably mounted on a driven shaft 2 and having a rectangular cross-section continuous circumferential groove 3. A shoe member 4 fits against the edge of the wheel over a portion of its circumference. An insert member 5, which can either be integral with or secured to the shoe member 4 projects into the groove 3 and terminates in an abutment member 6 which blocks the passageway formed by the walls and floor of the groove 3 of the wheel 1, and the insert member 5 of the shoe member 4. An extrusion orifice leads from the passageway and is provided in or is associated with the abutment 6. Instead of a single extrusion orifice, a plurality thereof can be provided, and subsequent reference to an extrusion orifice is to be construed as including the plural where the context so permits. FIG. 1 illustrates a single extrusion orifice 7 formed in the abutment 6.

In operation, a feedstock 8 is fed continuously into the groove 3 and upon rotation of the wheel 1 by the shaft 2, the feedstock 8 is carried forward in the groove 3 beneath the insert member 5 of the shoe member 4 and towards the abutment 6. As a result the feedstock 8 is continuously extruded through the die orifice 7.

The groove 3 in the wheel 1 in conjunction with the shoe member 4 and the insert member 5 form as above mentioned the passageway to receive the feedstock 8. That part of the passageway which is defined by the walls and floor of the groove 3 moves continuously toward the abutment. The remaining part of the passageway defined by the under-surface of the insert member 5 is stationary. The moving part, that is the part of the passageway defined by the groove 3, carries the feedstock 8 by friction drag towards the abutment member 6 and this movement is opposed by the friction at the stationary undersurface of the insert member 5. The frictional drag exerted by the walls and floor of the groove 3 in the wheel 1 is greater than the opposing frictional drag on the feedstock 8 due to the stationary under-surface of the insert member 5 and furthermore is sufficient to ensure that extrusion of the feedstock 8 takes place through the die orifice 7.

Figure 3:
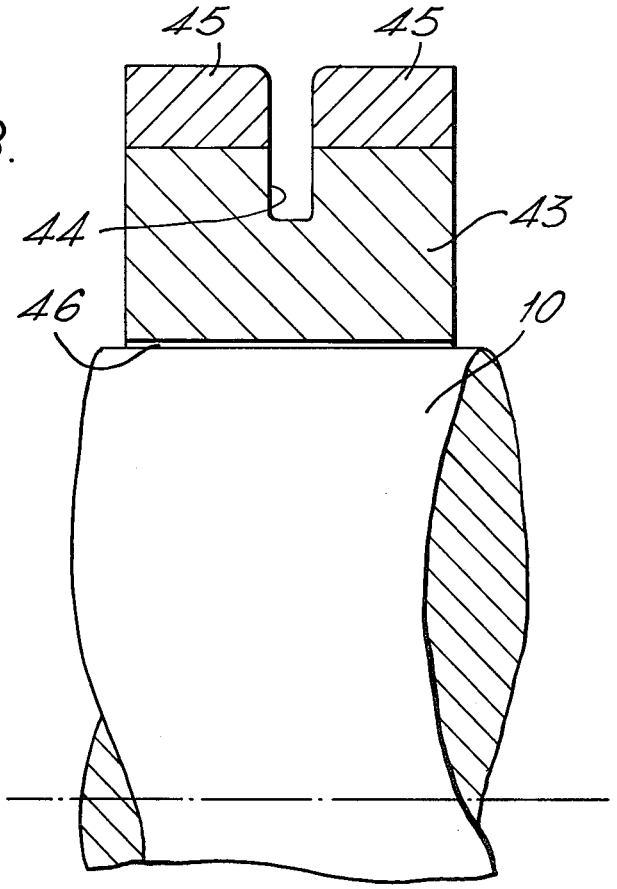
Figure 2:
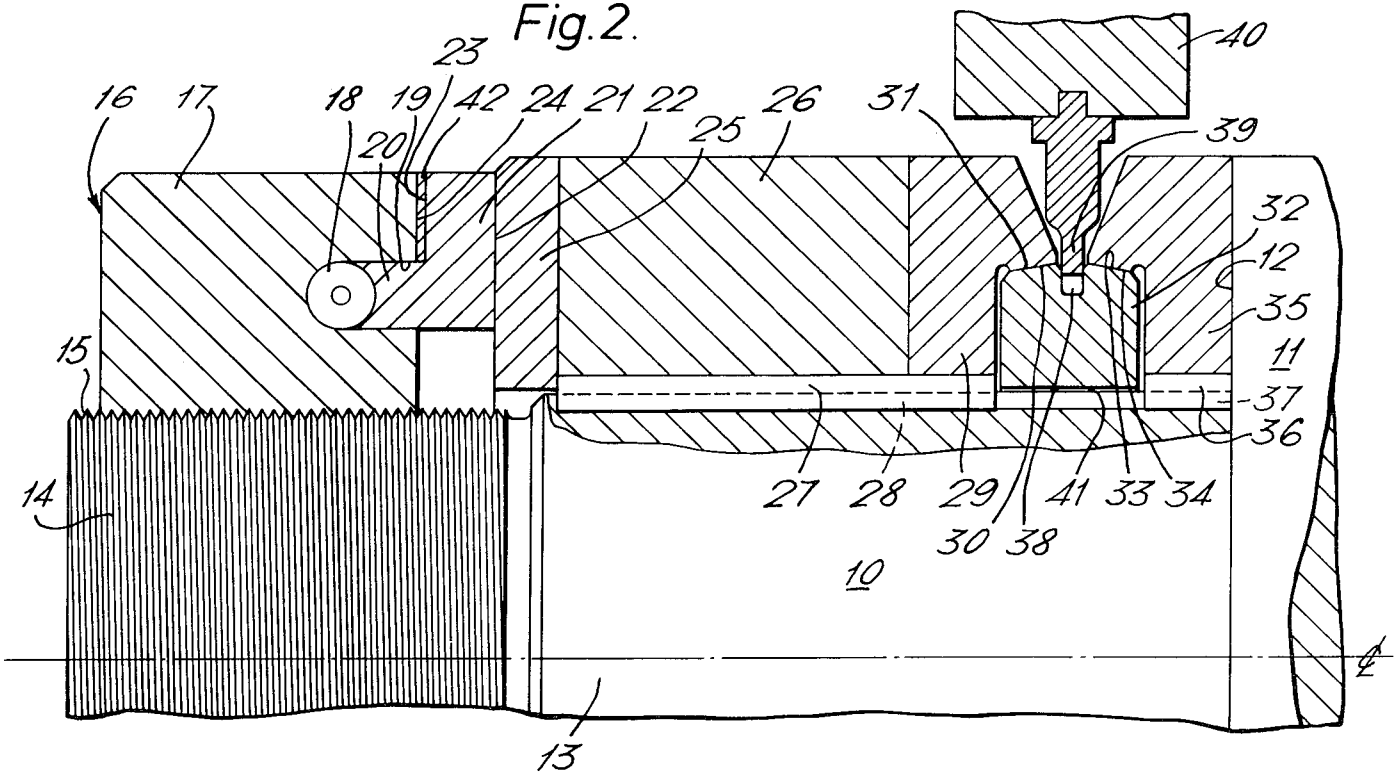

FIG. 1 illustrates the principle of operation of this kind of extrusion, which is continuous so long as feedstock continues to be fed to the groove 3 and extruded product from the die orifice 7 is removed. FIGS. 2 and 3 illustrate embodiments according to the invention and each provides a wheel constituted to reduce or avoid fatigue failure, such wheel and the parts associated with it, subsequently described, being applied to the kind of apparatus illustrated in FIG. 1 as the wheel 1 thereof.

Referring to FIG. 2, a driven member 10 corresponding to the driven shaft 2 of FIG. 1 has a portion 11 (a fragment only being shown but extending to the drive motor, not shown) providing an end face 12. A shaft portion 13 of the member 10 is of lesser diameter than the portion 11. A non-drive end portion 14 of the member 10 is formed with a screwthread 15 on to which a known kind of hydraulic nut generally referenced by numeral 16 is screwed. The nut 16 consists of a body 17 containing an annular internal bore 18 communicating with an annular cylinder 19 in which an annular piston 20 is slidable. The piston 20 has a side extension 21 forming an outer end face 22, and the extension 21 has an inner end face 23 opposing the inner end 24 of the body 17. A pressure-transmitting ring 25 contacts the outer end face 22 of the piston 20 and extension 21 and also contacts one end face of a force transmitting sleeve 26 keyed to the portion 13 of the member 10 using part of a key 27 in a keyway 28 in the drive shaft portion 13. The other end face of the sleeve 26 contacts a force-applying ring 29 having a tapered annular surface 30 bearing upon a complementary tapered surface 31 of a wheel member 32 corresponding to the wheel 1 of the FIG. 1 embodiment. The member 32 also has an annular tapered surface 33 contacted by a complementary tapered surface 34 of a ring 35 being a mirror image of the ring 29. The ring 35 bears on the said face 12 of the portion 11 of the drive member 10. The rings 29, 35 are keyed to the portion 13 of member 10 by key 27 and a key 36 with keyway 37 respectively. Instead of the keys 27, 36 and keyways 28, 37, connection between drive member 10 and the components in question (sleeve 26, and rings 29, 35) can be by splines or any other convenient torque-transmitting expedient.

The wheel member 32 has a groove 38 corresponding to groove 3 of the FIG. 1 embodiment, and the groove 38 is engaged over a part of its circumferential extent by an insert number 39 corresponding to the insert member 5 of the FIG. 1 embodiment, secured to a shoe member 40 corresponding to the shoe member 4 of the FIG. 1 embodiment. There are also an abutment member (not shown) corresponding to the abutment member 6 of the FIG. 1 embodiment and associated with the shoe member 40, and one or more die orifices (not shown), associated with the abutment member and/or the insert member 39. It is important that the wheel member 32 has clearance over the periphery of the portion 13 of drive member 10, such clearance being shown in FIG. 2 and designed 41. The wheel member 32 is keyed loosely in a radial sense to drive member 10 or is splined thereto (neither shown). Alternatively, if the compressive force subsequently to be described is sufficient, it may be possible to dispense with keying or splining and rely upon sufficient torque-transmitting force between wheel member 32 and drive member 10 being generated.

In operation, assuming the parts to be in the positions shown in FIG. 2 except for the piston 20 being in a position such that the face 23 is in contact with the face 24, hydraulic fluid from an intensifyer (not shown) is fed to the bore 18 and thence to the cylinder 19 and forces the piston 20 outwardly exerting a force on unkeyed pressure ring 25, sleeve 26, and ring 29, a reactive force in the opposite direction being exerted on ring 35 by virtue of the face 12 of portion 11 of drive member 10. The surfaces 30, 34 of the respective rings 29, 35 bear on the surfaces 31, 33 respectively of wheel member 32 and apply a stressing force to the wheel member 32 the effect of which, it can be shown, is the setting up of a compressive hoop stress in the wheel member 32 which reaches a maximum at its bore, ie at the annular surface adjacent the portion 13 of the drive member 10. The variables of preload applied by the hydraulic nut 16 and the angles of taper of the surfaces 30, 34, 31, 33 can be selected so as to give the appropriate precompression for the extrusion conditions under which the wheel will be operative, thereby preventing, or preventing propagation of, fatigue cracking.

Instead of the wheel member 32 being a single entity, as shown in FIG. 2, with the groove 38 being formed in the material thereof, the wheel member can be formed (not shown) of a plurality of close-fitting sectors each with a portion of the total circumferential groove formed in it.

To retain the stressing forces, a suitably dimensioned shim 42 is inserted in the gap between faces 23, 24 which is produced by the hydraulic force, and then the hydraulic fluid supply to duct 18 and cylinder 19 can be discontinued and disconnected.

FIG. 3 illustrates another alternative construction of wheel member. Assuming the wheel member, designated 43, to be similar to wheel member 1 of the FIG. 1 embodiment, the walls of the groove 44 in the wheel member 43 are extended outwardly by mirror image rings 45 shrunk on to the member 43 and spaced to give the correct width of groove extension. The shrinking-on provides that the necessary precompression to act against fatigue cracking is applied to the wheel member 43. As in the FIG. 2 embodiment, the wheel member 43 has to have initial (ie before the preshrinking) clearance designated 46 in FIG. 3, and the wheel member 43 may well require keying or splining, (not shown), loose in the radial sense, to drive member 10, unless it transpires that the preshrinking generates sufficient torque-transmitting force.

What is claimed is:

1. Apparatus for the forming of materials by extrusion, such apparatus comprising a wheel member with an endless groove in its periphery, a second member fixed relative to said wheel member and cooperating with the wheel member to define an elongate passageway therebetween for receiving at its inlet end material to be extruded at its extrusion end, means for rotating the wheel member in the direction of the passageway from inlet end to extrusion end, an abutment member fixed relative to the wheel member and projecting into the passageway at the extrusion end for blocking it, means defining at least one die orifice in the extrusion end of the passageway and leading therefrom, the material to be extruded being moved towards the die orifice means by frictional engagement with the walls of the endless groove constituting the major part of the passageway, characterised by the provision of means for prestressing the material constituting at least the walls of the endless groove of said wheel member, such means comprising means for preloading the wheel member via cooperating taper surfaces, of which said wheel member includes at least two, for superimposing a circumferential compression in the wheel member.

2. Apparatus according to claim 1, wherein said means for preloading the wheel member comprises a hydraulic nut.

3. Apparatus as claimed in claim 1 wherein the taper surfaces of said wheel are defined on the circumferential surface of the wheel on opposite sides of said peripheral groove and are oppositely tapered toward the axis of said wheel progressing outwardly from said groove, the other taper surfaces being carried by members on axially opposite sides of said wheel member with their taper surfaces located radially outwardly of the wheel surfaces but engaging said wheel surfaces, such that relative axial movement of the members toward the groove exerts a circumferential compression on the wheel portions adjacent said grooves.

4. Apparatus for the forming of materials by extrusion, such apparatus comprising a wheel member with an endless groove in its periphery, a second member fixed relative to said wheel member and cooperating with the wheel member to define an elongate passageway therebetween for receiving at its inlet end material to be extruded at its extrusion end, means for rotating the wheel member in the direction of the passageway from inlet end to extrusion end, an abutment member fixed relative to the wheel member and projecting into the passageway at the extrusion end for blocking it, means defining at least one die orifice in the extrusion end of the passageway and leading therefrom, the material to be extruded being moved towards the die orifice means by frictional engagement with the walls of the endless groove constituting the major part of the passageway, characterised by the provision of means for superimposing a circumferential compression in the wheel member, such means comprising shrink-fit rings circumferentially positioned on said wheel member and defining at least a part of the walls of said endless groove.

* * * * *